United States Patent [19]

Komatsu et al.

[11] 4,158,578

[45] Jun. 19, 1979

[54] METHOD FOR FORMING A CARBIDE LAYER OF A VA-GROUP ELEMENT OF THE PERIODIC TABLE OR CHROMIUM ON THE SURFACE OF A FERROUS ALLOY ARTICLE

[75] Inventors: Noboru Komatsu; Tohru Arai, both of Toyoake, Japan

[73] Assignee: Kabushiki Kaisha Toyota Chuo Kenkyusho, Japan

[21] Appl. No.: 902,696

[22] Filed: May 4, 1978

[30] Foreign Application Priority Data

May 9, 1977 [JP] Japan ..... 52/52800

[51] Int. Cl.[2] ..... C23C 9/10

[52] U.S. Cl. ..... 148/6.11; 427/399; 427/431

[58] Field of Search ..... 148/6.11; 427/431, 399

[56] References Cited

U.S. PATENT DOCUMENTS

| | | | |
|---|---|---|---|
| 3,671,297 | 6/1972 | Komatsu et al. | 428/472 X |
| 3,719,518 | 3/1973 | Komatsu et al. | 428/471 X |
| 3,885,059 | 5/1975 | Komatsu et al. | 427/431 X |
| 3,912,827 | 10/1975 | Komatsu et al. | 427/431 X |
| 3,922,405 | 11/1975 | Komatsu et al. | 148/6.11 X |
| 3,930,060 | 12/1975 | Komatsu et al. | 148/6.11 X |

OTHER PUBLICATIONS

Periodic Table of the Elements, Handbook of Chemistry and Physics, 54th Ed. 1973.

*Primary Examiner*—Ralph S. Kendall
*Attorney, Agent, or Firm*—Berman, Aisenberg & Platt

[57] ABSTRACT

A method for forming a boron-containing carbide layer on the surface of a ferrous alloy article by dipping the article in a molten bath. The bath is made by introducing boron and an oxide of a Va-Group element or of chromium into molten boric acid or a borate bath. The ratio of the boron to the oxide is between 7% and 40%. The carbide layer formed is very hard and has good oxidation resistance.

41 Claims, 8 Drawing Figures

METHOD FOR FORMING A CARBIDE LAYER OF A VA-GROUP ELEMENT OF THE PERIODIC TABLE OR CHROMIUM ON THE SURFACE OF A FERROUS ALLOY ARTICLE

BACKGROUND

There are several methods for coating metallic articles or for forming a metallic carbide layer thereon. Prior coating methods have a drawback. They use a molten treating bath containing metal particles. The metal particles need a relatively long time to dissolve in the bath, and undissolved metal particles deposit in the formed carbide layer, making a rough surface on the treated articles.

SUMMARY OF THE INVENTION

This invention relates to a method of forming a carbide layer of a Va-Group element of the Periodic Table or of chromium on the surface of the ferrous-alloy article and a treating material for forming a treating bath. The method requires maintaining an article of a carbon-containing ferrous alloy immersed in the molten treating bath for a period of time. The ferrous alloy article, with the carbide layer formed thereon, has greatly improved hardness and oxidation resistance, as well as a very smooth surface.

A fine and uniform carbide layer of a Va-Group element or of chromium is formed on the surface of a ferrous alloy article in a molten treating bath consisting essentially of boric acid or a borate in addition to an oxide of a carbide-forming element [hereafter: (CFE)], such as a Va-Group element of the Periodic Table and chromium (U.S. Pat. No. 3,719,518 and U.S. Pat. No. 3,671,297), and a boron-supplying material. The method is highly productive. The carbide of a Va-Group element, such as vanadium carbide (VC), niobium carbide (NbC) and tantalum carbide (TaC), and chromium carbide (CrC) are very hard. Therefore, the formed carbide layer is extremely hard and has superior wear resistance. It is highly suitable for surfaces of molds, such as dies and punches, of tools, such as pinchers and screwdrivers, of parts for many kinds of tooling machines and of automobile parts subjected to wear.

The principal object of this invention is to provide an improved method for forming a carbide layer of a Va-Group element or of chromium on the surface of a ferrous-alloy article in a molten treating bath. Other objects include the treating material for forming a treating bath.

Another object of this invention is to provide a method for forming a carbide layer which is very hard and has high oxidation resistance.

A further object of this invention is to provide a method for forming a dense and uniform carbide layer (without any undissolved treating metal particles) adhered to the surface of the article.

A still further object of this invention is to provide a treating material bath which is capable of forming a carbide layer (having a smooth surface) on a ferrous-alloy article.

BRIEF DESCRIPTION OF DRAWINGS

Each of FIGS. 1 to 8 is a chart which illustrates the effect of changes of the kind and amount of CFE oxides and of boron-supplying material added to a borax bath to form a carbide layer.

DETAILS

The invention, together with additional objects and advantages, are apparent from the following description of specific embodiments when read in connection with accompanying drawings.

Figure 1:
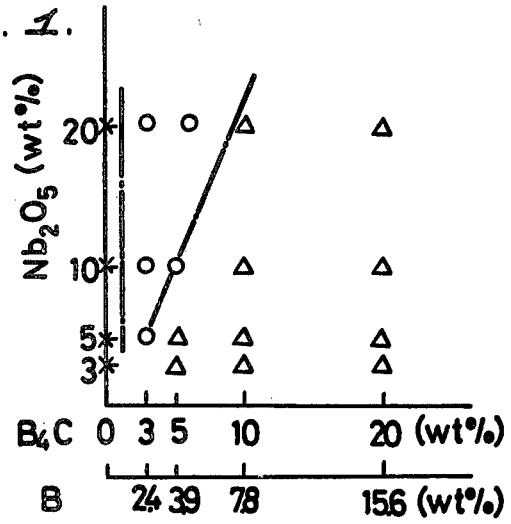
Figure 2:
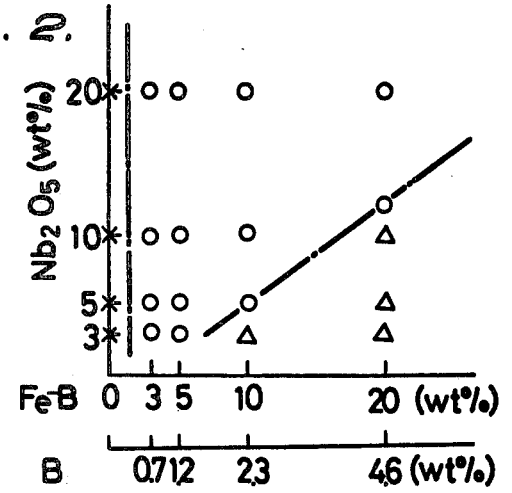
Figure 3:
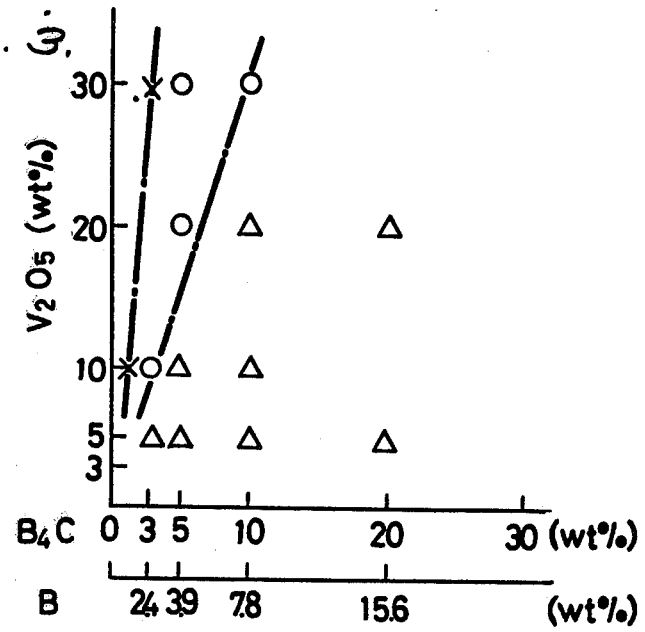
Figure 4:
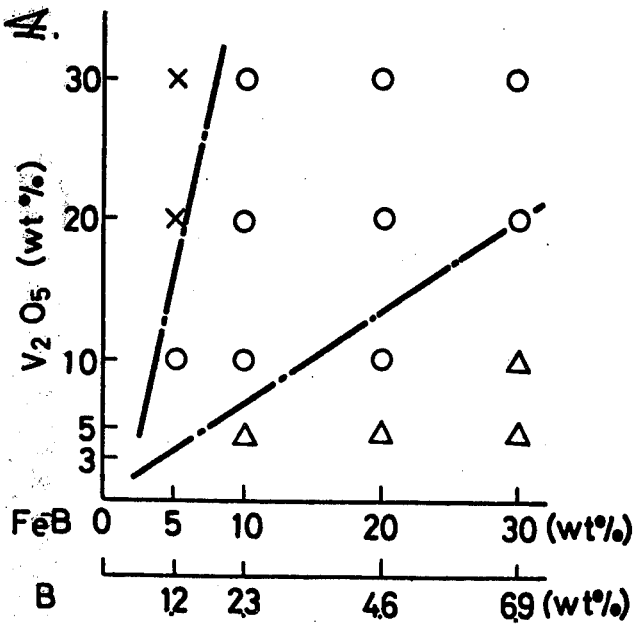
Figure 5:
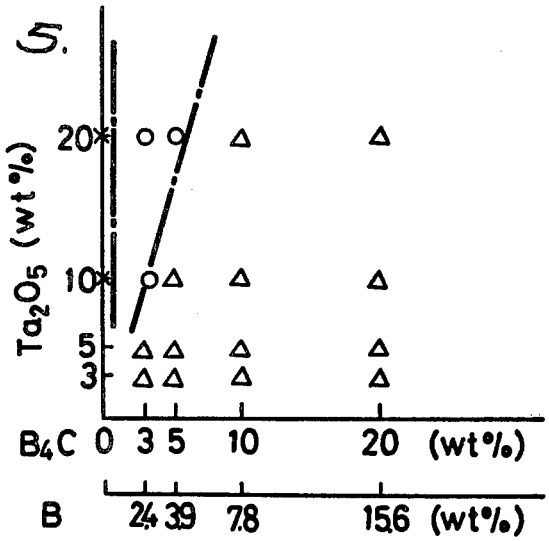
Figure 6:
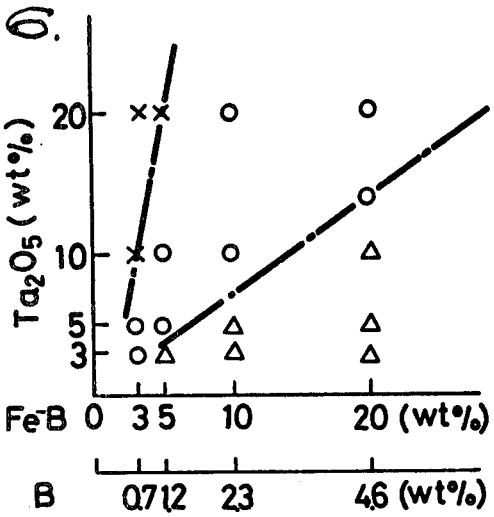
Figure 7:
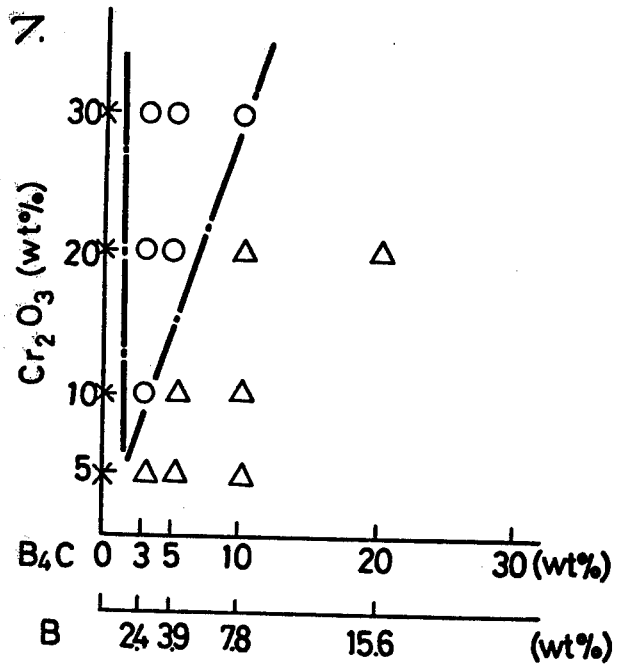
Figure 8:
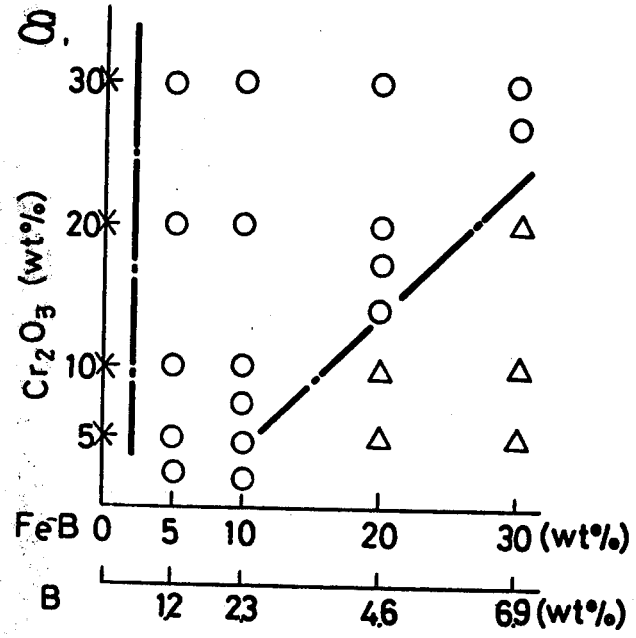

FIG. 1 and FIG. 2 reflect the use of $Nb_2O_5$ as the CFE oxide. $B_4C$ is the boron-supplying material in FIG. 1, whereas ferroboron (Fe—B) is the boron-supplying material in FIG. 2. FIG. 3 and FIG. 4 reflect the use of $V_2O_5$ as the CFE oxide. Data for FIG. 3 are based on $B_4C$ as the boron-supplying material, and those for FIG. 4 are based on ferroboron (Fe—B) as the boron-supplying material. FIG. 5 and FIG. 6 reflect the use of $Ta_2O_5$ as the CFE oxide. Data for FIG. 5 are based on $B_4C$ as the boron-supplying material, and those for FIG. 6 are based on (Fe—B) as the boron-supplying material. FIG. 7 and FIG. 8 reflect the use of $Cr_2O_3$ as the CFE oxide. Data for FIG. 7 are based on $B_4C$ as the boron-supplying material, and those for FIG. 8 are based on (Fe—B) as the boron-supplying material.

Broadly, the present invention is directed to an improvement in the method for forming a CFE-carbide layer on the surface of a ferrous alloy article in a boric acid or borate molten treating bath and is characterized by the fact that the molten treating bath is prepared by dissolving CFE therein in the form of an oxide of a Va-Group element or of chromium and further incorporating a particular type of boron-supplying material in the molten bath. More specifically, the method of the present invention comprises: (a) heating boric acid or a borate until it is molten and thus forms a molten bath, (b) introducing an oxide of a Va-Group element or of chromium along with boron-supplying material (wherein the boron is not bonded to oxygen) into the molten bath to prepare the molten treating bath and (c) immersing the article in the molten treating bath to form a carbide layer of a Va-Group element or of chromium on the surface of the article. The carbide layer has superior oxidation resistance and also has a very smooth surface.

Upon intensive investigation of the mechanism for forming a carbide layer on the surface of an article by diffusing a Va-Group element or chromium (all references in this text to CFE are to these elements) from the molten treating bath composed mainly of (a) boric acid or borate, (b) a CFE oxide and (c) boron-supplying material, it was found that the main source of CFE came from the dissolved element in the molten treating bath rather than directly from an undissolved solid metal particle.

To dissolve CFE in the molten treating bath (to form a carbide layer having a smooth surface), CFE oxide was introduced into the molten bath rather than metal powder. The CFE oxide easily and quickly dissolves in a molten bath of boric acid or of borate. However, the resulting molten bath fails to form a carbide layer on an article (composed of carbon-containing ferrous alloy) immersed in the bath containing dissolved CFE oxide. A boron-supplying material (wherein the boron is not bonded to oxygen) must be incorporated in the molten bath together with the CFE oxide. The boron-supplying material reduces the CFE oxide, facilitates dissolving the CFE in the bath and enables the bath to form a carbide layer on the surface of the article immersed therein.

With regard to the ratio of the boron-supplying material to the CFE oxide, too much boron-supplying material results in forming (on the article) a boride layer composed of FeB or $Fe_2B$ due to the excess boron dissolved in the bath. On the other hand, too little boron-supplying material results in the formation of no layer. A suitable range depends largely on the kind and the particle size of the boron-supplying material. A suitable range of $B_4C$ is lower than that B), (Fe—M) and such range is lowered as the particle size of the boron-supplying material decreases. Generally speaking, the weight of boron in the boron-supplying material is between 7% and 40% of the weight of the CFE oxide. The ratio is shown by the equation:

$$\% = \frac{\text{the weight of the boron included in the boron-supplying material}}{\text{the weight of the oxide}} \times 100$$

When $B_4C$ is the boron-supplying material, the upper limit of the ratio is lowered to 20%. With regard to the lower limit of the ratio, about 10% or more is preferable to continue the steady formation of a carbide layer.

Also, the suitable range is affected by other treating conditions, such as the particular CFE and the treating temperature. Thus, the ratio is somewhat dependent on treating conditions.

The formed carbide layer has a structure in which boron is in a solid solution with carbide; as the ratio of boron increases, a layer (formed under the carbide layer) composed of FeB or $Fe_2B$ also increases. When the ratio of boron increases beyond the previously-noted upper limit, the object of the present invention is not attained because a layer of FeB or $Fe_2B$ is exclusively formed.

The CFE oxide and boron-supplying material are incorporated into the bath in the form of powder or flakes, instead of as metal particles, to facilitate easy and quick dissolution in the molten bath. A preferred particle size range of the boron-supplying material is from −100 to −325 mesh.

*The CFE oxide can dissolve easily and quickly in the molten bath of boric acid or a borate, any size of CFE oxide, such as powder, flakes and granules, can be used.

The whole amount of the CFE oxide and of the boron-supplying material is preferably 60% or less of the whole amount of the bath to avoid having an unduly viscous bath. As CFE oxide and boron-supplying material content increases, the viscosity of the bath increases. When the viscosity of the molten treating bath is too high, the bath material adheres to the article and is thus removed from the bath together with the treated article. Also, high viscosities impede distribution of components and result in temperature variations because of decreased fluidity of the bath.

As the substance of the bath, boric acid ($B_2O_3$) or borate, such as an alkali-metal borate, e.g. sodium borate (borax—$Na_2B_4O_7$), potassium borate ($K_2B_4O_7$) and the like and the mixtures thereof, are used. The boric acid and borate function to dissolve the CFE oxide and to keep the surface of the article (to be treated) clean. Also boric acid and borate are not poisonous and hardly vaporize. Therefore, the method of the present invention can be carried out in the open air. Also, as the substance of the bath, other types of boric oxide, such as $KBP_2$ and $KH_2BO_3$, are useful.

As the Va-Group elements dissolve in the molten treating bath, one or any combination of vanadium (V), niobium (Nb) and tantalum (Ta) is used.

As the CFE oxides, any type of niobium oxides, tantalum oxides, vanadium oxides, and chromium oxides other than $Nb_2O_5$, $Ta_2O_5$, $V_2O_5$ and $Cr_2O_3$ can be used.

As the boron-supplying material, the single substance of boron, a boron compound, such as ferro boron (FE—B), nickel boron (Ni—B), boron carbide ($B_4C$), boron nitride (BN) and boron halide, e.g. boron chloride ($BCl_3$), is used.

The treated ferrous alloy must contain at least 0.1% by weight of carbon. The carbon in the article enters into the composition of the carbide layer formed during the treatment. It is presumed that carbon in the ferrous-alloy article diffuses to the surface thereof and reacts with the CFE in the molten treating bath to form a carbide layer on the surface of the article. A higher carbon content in the article is preferred for forming the carbide layer. A ferrous-alloy article containing less than 0.1% by weight of carbon may not be provided with a uniform and thick carbide layer by the subject treatment.

The ferrous alloy referred to herein is carbon steel or carbon-containing alloy steel.

Before treatment, it is important to purify or cleanse the surface of the article in order to form a good carbide layer. This is effected, e.g., by washing off any rust or oil from the surface of the article with an acidic aqueous or other liquid.

The treating temperature is optionally within a wide range from the melting point of boric acid or borate to the melting point of the article to be treated. Preferably, the treating temperature is within the range of from 850° to 1100° C. At a temperature below 850° C., the viscosity of the bath is so high that it is difficult to form a uniform carbide layer. On the other hand, at a temperature above 1100° C., the quality of the material forming the article to be treated may deteriorate.

The treating time depends upon the thickness of the carbide layer to be formed. Usually the preferable range of treating time is from 1 to 20 hours.

From the preceding description one skilled in the art can use the subject invention to its fullest extent. The following specific embodiments are merely illustrative and do not limit the remainder of the disclosure in any way whatsoever.

EXAMPLE 1

(1) Dehydrated borax ($Na_2B_4O_7$) was introduced into a crucible made of heat-resistanct steel and heated in an electric furnace to melt the borax. A bath of 950° C. was prepared. A treating bath was made by adding granular $Nb_2O_5$ and then $B_4C$ powder (−325 mesh) little by little while stirring the prepared bath. Many kinds of baths were prepared in the same manner by changing the composition ratio of $Nb_2O_5$ and $B_4C$. Test pieces made of JIS SK 4 (carbon tool steel)* with a diameter of 7 mm were immersed into each of the treating baths and kept therein for 2 hours, taken out therefrom and cooled in oil baths. Any treating material adhering to the surface of the test pieces was removed by washing with hot water. After cutting the test pieces, cross sections of each were observed micrographically. The results are shown in FIG. 1, wherein the ordinate represents the content of $Nb_2O_5$ in the baths, the upper abscissa represents the content of $B_4C$ in the baths, and the lower abscissa represents the content of boron (B) [converted from the content of $B_4C$]. Also, mark o represents a test piece on which a NbC layer was formed, mark Δ represents a test piece on which a layer of FeB or $Fe_2B$ was formed, and mark X represents a test piece on which no layer was formed. (These symbols have the same meanings in all of the figures.)

*Japanese Industrial Standard SK 4 Chemical Composition p(%) (C:0.90–1.00 Si:0.35 or less, Mn: 0.50 or less P:0.030 or less S:0.030 or less Fe: the rest).

A bath containing 10% of $Nb_2O_5$ and 3% of $B_4C$ (2.4% of B) formed a layer of NbC with a 0.7μ thickness, and a bath containing 10% of $Nb_2O_5$ and 5% of $B_4C$ (3.9% of B) formed a 0.6μ thick layer consisting of two layers, the uppermost one being a NbC layer and the other one (formed beneath the NbC layer) being a $Fe_2B$ layer. However, baths containing 10% of $B_4C$ (7.8% B) or 20% of $B_4C$ (15.6% B) did not attain the object of the present invention because the baths formed exclusively a $Fe_2B$ layer having a thickness of 40μ and 63μ, respectively. Strictly speaking, the NbC layers used in the specification are layers of Nb(C,B) in which a part of C is replaced with B. The content of B increases with an increase in the content of $B_4C$. The surfaces of all treated test pieces were smooth, and no powder adhesions were observed. In the figure, the area enclosed with a dot-dash line shows the composition range in which a NbC layer can be formed, and it is seen from this that the composition ratio of B to $Nb_2O_5$ is about 40% or less or from about 7 to about 40%.

(2) The test-pieces with a NbC layer which were obtained by the method mentioned in (1) were placed in an air atmosphere in an electric furnace of 550° C., kept there for 10 minutes, and then cooled in the air while observing the surface of each piece. These steps were repeated. Also, for comparative data, a test piece was made of JIS SK 4 to form a NbC layer of 9μ thickness by dipping it in a treating bath composed of molten borate and (as additive) 20% by weight of ferroniobium (Fe—Nb) powder. It was tested by the same previously-noted steps. The results are shown in Table.

TABLE

COMPARATIVE TEST DATA

| Bath Composition Nos. of Cycle | Fe-Nb powder 20% | $Nb_2O_5$ powder 10% $B_4C$ 3% | $Nb_2O_5$ powder 10% $B_4C$ 5% |
|---|---|---|---|
| 40 | no peeling | no peeling | no peeling |
| 60 | partial peeling | partial peeling | the same as above |
| 100 | complete peeling | partial peeling | the same as above |

The comparative piece was gradually discolored by oxidation of NbC as the cycles increased, and peeling occurred before the 60th cycle; the layer was completely peeled off by the 100th cycle.

Compared with this result, although peeling occurred, with test pieces treated in the bath containing 10% by weight of $Nb_2O_5$ and 3% by weight of $B_4C$ (according to the present invention) complete peeling did not occur even after the 100th cycle. The test pieces reflected greater oxidation resistance. Especially, in a test piece of the present invention treated in a bath containing 10% of $Nb_2O_5$ and 5% of $B_4C$, no peeling was found even after the 100th cycle.

(3) Other test pieces were treated and tested by the same method and conditions, except that ferroboron (Fe—B) (−100mesh) was used as the boron-supplying material instead of $B_4C$. The results are shown in FIG. 2. The upper limit of B to $Nb_2O_5$ is about 38%, and the overall range is thus from about 7 to about 38%. A layer of $Fe_2B$ is formed exclusively when the indicated upper limit is exceeded.

EXAMPLE 2

Like Example 1, many different treating baths were prepared from borax (as the main ingredient), different types and amounts of CFE oxides and of the boron-supplying material. Test pieces made of JIS SK 4 were prepared and immersed in separate molten treating baths for 2 hours to form a covering layer thereon. The results are shown in FIGS. 3 to 8.

FIGS. 3 and 4 reflect results obtained by using $V_2O_5$ as CFE oxide. The data of FIG. 3 were obtained by using $B_4C$ (−325mesh) as the boron-supplying material; those of FIG. 4, by using (Fe—B). Where $V_2O_5$ and $B_4C$ were used (cf. FIG. 3), a NbC layer was formed with an amount of B within a range of from about 7 to about 25% of the amount of $V_2O_5$. No layer was formed when the composition ratio of B to $V_2O_5$ was below 7%, and a $Fe_2B$ layer or a FeB layer was exclusively formed when the B content of the boron-supplying material exceeded 38% of $V_2O_5$ content. Similarly, in those cases wherein $V_2O_5$ and Fe—B were used, the B content of the boron-supplying material was suitable for producing a VC layer when in the range of from about 7 to about 35% of the $V_2O_5$ content.

FIGS. 5 and 6 reflect results obtained by using $Ta_2O_5$ as CFE oxide. The data of FIG. 5 were obtained by using $B_4C$ as the boron-supplying material; those of FIG. 6, by using (Fe—B). Suitable treating-bath compositions have a ratio of B (from the boron-supplying material) to $Ta_2O_5$ of from about 7 to about 24% in the former case and of from about 7 to about 35% in the latter case.

FIGS. 7 and 8 reflect results obtained by using $Cr_2O_3$ as CFE oxide. The data of FIG. 7 were obtained by using $B_4C$ as the boron-supplying material; those of FIG. 8 by using Fe—B. Suitable treating-bath compositions have a ratio of B (from the boron-supplying material) to $Cr_2O_3$ of from about 7 to about 26% in the former case and of from about 7 to about 32% in the latter case.

As previously mentioned, a molten treating bath of boron oxide or borate, in which a CFE oxide and boron are incorporated, is basic to the present invention. The formulation of a carbide layer on the surface of an article to be treated is due to oxide reduction by boron and the creation of CFE atoms in the bath. Generally, whether or not a reduction reaction occurs depends on the change in free energy generated during the reaction. However, it is not always possible to make an accurate prediction based only on the change in free energy. Further, in the present invention, since the oxide composition in the bath may possibly be completely different from the totality of added components, it is difficult to determine the oxide composition in the treating bath based on contributing ingredients.

The invention and its advantages are readily understood and appreciated from the preceding description. Various changes may be made in the compositions, treating baths and coated articles without departing from the spirit and scope of the invention or sacrificing its material advantages. The previously-described compositions, process and products are merely illustrative of embodiments of the invention.

What is claimed is:

1. In a method for forming a carbide layer on an article of carbon-containing ferrous alloy, the following sequential steps:

(a) preparing a molten (boric acid or borate)/CFE-oxide/(boron-supplying material) treating bath, CFE being a carbide-forming element selected from the group consisting of a Va group element and chromium and the boron-supplying material being one wherein boron is not bound to oxygen, (b) immersing the article into the molten treating bath, (c) maintaining said article in said molten treating bath for a period sufficient to form a carbide layer of said CFE on the surface of said article and (d) removing said article from said molten treating bath.

2. A method according to claim 1 for forming a carbide layer on an article of carbon-containing ferrous alloy which comprises heating boric acid or a borate to its molten state to form a molten bath, introducing an oxide of CFE, CFE being a carbide-forming element selected from the group consisting of a V-a group element and chromium, and a boron supplying material wherein boron is not bound to oxygen into the molten boric acid or borate bath, immersing said article into said molten treating bath, maintaining said article in said molten treating bath for a period sufficient to form a carbide layer of said CFE on the surface of said article, and removing said article from said molten treating bath.

3. A method according to claim 2, which comprises forming the bath by incorporating said oxide and boron-supplying material, in powder or flake form, in said molten boric acid or borate bath.

4. A method according to claim 2, wherein the whole amount of said oxide and boron-supplying material is less than 60% of the whole amount of said bath.

5. A method according to claim 2, wherein said weight of boron in the boron-supplying material is between 7% and 40% of the weight of said CFE oxide.

6. A method according to claim 1, which comprises maintaining said article in said molten treating bath for from 1 to 20 hours at a temperature ranging from 850° to 1,100° C.

7. A method according to claim 1, wherein said ferrous alloy is a member selected from the group consisting of carbon steel and carbon-containing alloy steel.

8. A method according to claim 1, wherein said borate is a member selected from the group consisting of sodium borate, potassium borate and a mixture thereof.

9. A method according to claim 1, wherein said CFE oxide is a member selected from the group consisting of vanadium oxides, niobium oxides, tantalum oxides, chromium oxides and a mixture of two or more such oxides.

10. A method according to claim 1, wherein said boron-supplying material is a simple substance of boron.

11. A method according to claim 1, wherein said boron-supplying material is a boron compound.

12. A method according to claim 11, wherein said boron compound is a member selected from the group consisting of ferroboron, nickel boron, boron carbide, boron nitride and boron halide.

13. A method according to claim 1, wherein said boron-supplying material is boron carbide, said CFE oxide is a niobium oxide, and the weight of boron in said boron carbide is between 7% and 40% of the weight of said niobium oxide.

14. A method according to claim 1, wherein said boron-supplying material is ferroboron, said oxide is a niobium oxide, and the weight of boron in said ferroboron is between 7% and 38% of the weight of said niobium oxide.

15. A method according to claim 1, wherein said boron-supplying material is boron carbide, said CFE oxide is a vanadium oxide, and the weight of boron in said boron carbide is between 7% and 25% of the weight of said vanadium oxide.

16. A method according to claim 1, wherein said boron-supplying material is ferroboron, said CFE oxide is a vanadium oxide, and the weight of boron in said ferroboron is between 7% and 35% of the weight of said vanadium oxide.

17. A method according to claim 1, wherein said boron-supplying material is boron carbide, said CFE oxide is a tantalum oxide, and the weight of boron in said boron carbide is between 7% and 24% of the weight of said tantalum oxide.

18. A method according to claim 1, wherein said boron-supplying material is ferroboron, said CFE oxide is a tantalum oxide, and the weight of boron in said ferroboron is between 7% and 35% of the weight of said tantalum oxide.

19. A method according to claim 1, wherein said boron-supplying material is boron carbide, said CFE oxide is a chromium oxide, and the weight of boron in said boron carbide is between 7% and 26% of the weight of said chromium oxide.

20. A method according to claim 1, wherein said boron-supplying material is ferroboron, said CFE oxide is a chromium oxide, and the weight of boron in said ferroboron is between 7% and 32% of the weight of said chromium oxide.

21. A method according to claim 1 wherein the ratio of boron-supplying material to CFE oxide is effective to produce the carbide layer on said article.

22. A method according to claim 1 wherein the weight of boron in the boron-supplying material is between 7 and 40 percent of the weight of CFE oxide.

23. A method according to claim 22 wherein the CFE oxide and the boron-supplying material comprise at most 60 percent of the treating bath.

24. A method of forming a mixed carbide layer of an element selected from the group consisting of vanadium, niobium, tantalum and chromium on an article of ferrous alloy containing at least 0.1 percent by weight of carbon, which comprises preparing a molten treating bath having a composition according to claim 1, immersing the article into the molten treating bath, maintaining said article in said molten treating bath to form the mixed carbide layer on the article, and removing said article from said treating bath.

25. A treating material for forming a carbide layer on an article of carbon-containing ferrous alloy which is composed of boric acid or a borate, an oxide of CFE, CFE being a carbide forming element selected from the group consisting of a V-a group element and chromium, and a boron-supplying material in which boron is not bound to oxygen.

26. A treating material according to claim 25, wherein said oxide and boron-supplying material are in powder or flake form.

27. A treating material according to claim 25, wherein the whole amount of said oxide and boron-supplying material is less than 60% of the whole amount of said treating material.

28. A treating material according to claim 27, wherein the weight of boron in said boron-supplying material is between 7% and 40% of the weight of said CFE oxide.

29. A treating material according to claim 28, wherein said borate is a member selected from the group consisting of sodium borate, potassium borate and a mixture thereof.

30. A treating material according to claim 28, wherein said CFE oxide is a member selected from the group consisting of vanadium oxides, niobium oxides, tantalum oxides, chromium oxides and a mixture of two or more such oxides.

31. A treating material according to claim 28, wherein said boron-supplying material is a simple substance of boron.

32. A treating material according to claim 28, wherein said boron-supplying material is a boron compound.

33. A treating material according to claim 32, wherein said boron compound is a member selected from the group consisting of ferroboron, nickel boron, boron carbide, boron nitride and boron halide.

34. A treating material according to claim 28, wherein said boron-supplying material is boron carbide and said CFE oxide is a niobium oxide.

35. A treating material according to claim 28, wherein said boron-supplying material is ferroboron, said oxide is a niobium oxide, and the weight of boron in said ferroboron is between 7% and 38% of the weight of said niobium oxide.

36. A treating material according to claim 28, wherein said boron-supplying material is boron carbide, said CFE oxide is a vanadium oxide, and the weight of boron in said boron carbide is between 7% and 25% of the weight of said vanadium oxide.

37. A treating material according to claim 28, wherein said boron-supplying material is ferroboron, said CFE oxide is a vanadium oxide, and the weight of boron in said ferroboron is between 7% and 35% of the weight of said vanadium oxide.

38. A treating material according to claim 28, wherein said boron-supplying material is boron carbide, said CFE oxide is a tantalum oxide, and the weight of boron in said boron carbide is between 7% and 24% of the weight of said tantalum oxide.

39. A treating material according to claim 28, wherein said boron-supplying material is ferroboron, said CFE oxide is a tantalum oxide, and the weight of boron in said ferroboron is between 7% and 35% of the weight of said tantalum oxide.

40. A treating material according to claim 28, wherein said boron-supplying material is boron carbide, said CFE oxide is a chromium oxide, and the weight of boron in said boron carbide is between 7% and 26% of the weight of said chromium oxide.

41. A treating material according to claim 28, wherein said boron-supplying material is ferroboron, said CFE oxide is a chromium oxide, and the weight of boron in said ferroboron is between 7% and 32% of the weight of said chromium oxide.

* * * * *